United States Patent [19]

Noguchi et al.

[11] Patent Number: 4,789,148

[45] Date of Patent: Dec. 6, 1988

[54] ALIGNING-AND-FEEDING APPARATUS FOR FLAT ARTICLES

[75] Inventors: Masahiko Noguchi; Kiyoshi Tsuda, both of Tokyo, Japan

[73] Assignee: NEC Corporation, Japan

[21] Appl. No.: 938,267

[22] Filed: Dec. 5, 1986

[30] Foreign Application Priority Data

Dec. 6, 1985 [JP] Japan ..... 60-188587[U]

[51] Int. Cl.[4] ..... B65H 1/02; B65H 3/62

[52] U.S. Cl. ..... 271/94; 271/31.1; 271/34; 271/146; 271/149

[58] Field of Search ..... 271/146, 149, 150, 31.1, 271/178, 179, 221, 94, 34

[56] References Cited

U.S. PATENT DOCUMENTS 3,647,203 3/1972 De Hart ..... 271/149 X
4,299,379 11/1981 Preston ..... 271/149 X
4,432,540 2/1984 Akers ..... 271/149 X
4,518,160 5/1985 Lambrechts ..... 271/179 X
4,523,753 6/1985 Hiromori ..... 271/149 X

FOREIGN PATENT DOCUMENTS 1589202 5/1981 United Kingdom .

*Primary Examiner*—Richard A. Schacher
*Attorney, Agent, or Firm*—Laff, Whitesel, Conte & Saret

[57] ABSTRACT

The invention provides a machine for aligning and feeding flat articles such as letters, postcards, and the like. The flat articles are transported while in a standing mode and while being vibrated to align them. A conical roller is rotatably mounted near the end of the transport path and is oriented to direct the articles in a direction opposite the direction of travel. The conical roller has at least one flat side to vibrate the standing articles so that they will feed one-by-one.

3 Claims, 3 Drawing Sheets

ALIGNING-AND-FEEDING APPARATUS FOR FLAT ARTICLES

BACKGROUND OF THE INVENTION

This invention relates to an aligning-and-feeding apparatus for flat articles such as post cards and envelopes, in which massively-stacked flat articles are aligned in standing state and fed piece by piece.

In a conventional aligning-and-feeding apparatus of this kind, flat articles stacked in standing state are transferred to a feeding section while two sides of the flat article are supported by guide plates. At the feeding section, the flat articles are delivered externally piece by piece by using, for example, a suction belt. When the flat article is transferred to the feeding section, aligning operation is done by vibrating the flat article by means of vibrating means attached to the guide plates.

The vibration force applied to the stacked flat articles is only in the direction perpendicular to the transferring direction of the flat articles to the feeding section in a prior art. Therefore, the density of the stacked flat articles cannot be equalized in the transfer direction, and two or more pieces are frequently fed at once from the feeding section.

In order to feed flat articles piece by piece reliably, it is necessary that flat articles be stacked in softly-contacting state rather than in close-contacting state at a location immediately before the feeding section, and that the stacked flat articles be not urged forcibly against the feeding section. However, in the prior art, no vibration force is applied in the transfer direction, so that the piece-by-piece feeding of the flat articles cannot be performed stably and reliably.

SUMMARY OF THE INVENTION

Therefore, it is an object of the present invention to provide a flat article aligning-and-feeding apparatus capable of feeding piece-by-piece the flat articles stably and reliably.

According to the present invention, a flat-article aligning-and-feeding apparatus comprises a stacking section adapted to stack a plurality of flat articles or sheets in standing state, a transfer means for transferring the sheets in standing state towards one end portion of the stacking section, a vibratory aligning mechanism adapted to apply a vibratory force to the sheets, which are being sent by the transfer means, and thereby set the posture thereof, a feeding section provided in a position adjacent to the end portion of the stacking section and adapted to feed the sheets, which are transferred thereto, sequentially to a subsequent stage, and at least one conical roller provided rotatably in such a location in the stacking section that is close to the feeding section and having an inclined surface capable of collecting the lower end portions of the sheets in the direction opposite to the direction in which the sheets are transferred, which conical roller has at least one flat surface portion in the inclined surface.

DESCRIPTION OF THE PREFERRED EMBODIMENT

Figure 1:
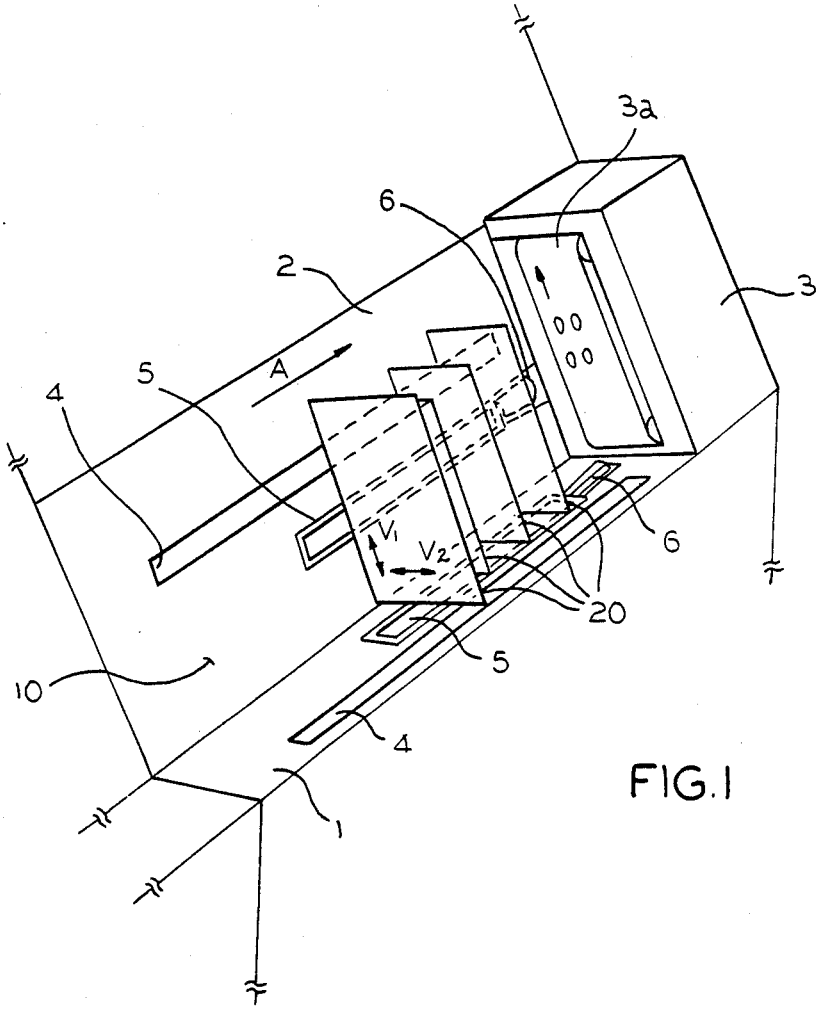
FIG. 1 is a schematic perspective view showing an embodiment of the present invention.

Referring to FIG. 1, an embodiment of the present invention includes a stacker section 10 and a feeding section 3 provided at an end of the stacker section 10. The stacker section 10 includes a pair of guide plates 1 and 2 on which a pair of transfer mechanisms 4, a pair of vibration mechanisms 5 and a pair of conical rollers 6 are provided, respectively. The feeding section 3 includes a suction belt 3*a*.

In operation, flat articles 20 such as postal matters are stacked in standing state along the guide plates 1 and 2, and transferred in the horizontal direction A by the transfer mechanisms 4 consisting of, for example, forks and transfer belts. The flat articles 20 thus transferred reach the feeding section 3. In the feeding section 3, each of flat articles 20 is adsorbed to a suction belt 3*a* and, in accordance with movement of the suction belt 3*a*, fed to a subsequent process stage (not shown). During the transfer, a vibration force in the vertical direction is applied by the vibration mechanisms 5 to the flat articles 20. In this case, the vibration mechanisms 5 provide vibration forces in the upward-and-downward direction $V_1$ and in the forward-and-backward direction $V_2$, respectively, to the flat articles. As a result, the posture of the flat articles 20 can be aligned at two sides thereof while engaging with the guide plates 1 and 2.

Figure 2A:
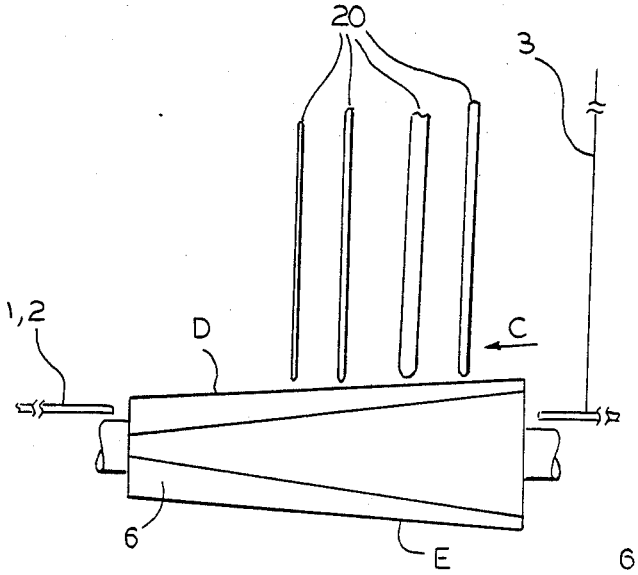
FIG. 2*a* is a schematic cross-sectional view of a principal portion of the embodiment shown in FIG. 1
Figure 2B:
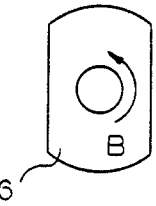
FIG. 2*b* is a cross-sectional view of a conical roller used in the embodiment of FIG. 1.

Two conical rollers 6 are provided in the guide plates 1 and 2 at the end portion of the stacking section 10 and before the feeding section 3. Referring also to FIGS. 2*a* and 2*b*, each of the conical rollers 6 has a larger-diameter portion at the end thereof on the side of the feeding section 3 and two outer circumferential portions of each conical roller 6 are longitudinally cut off along two parallel planes as shown in FIG. 2*b*. When this conical roller 6 is rotated in the direction B, the flat articles 20 transferred onto the conical roller 6 are vibrated vertically and longitudinally due to the shape of the conical roller 6. Further, by the rotation of the conical roller 6, a force to transfer the flat articles in the reverse direction C (FIG. 2*a*) is generated due to inclined surfaces D and E on the conical roller 6. Owing to such force in the reverse direction C, the stacked flat articles 20 are subject to separation to each other just before the feeding section 3 and, thus, the flat articles 20 can be fed out piece by piece sequentially and smoothly from the feeding section 3 while preventing multi-feeding.

In the aforementioned embodiment, the conical roller is longitudinally cut out so as to be flat at two circumferential surface portions. However, a sectional shape of a conical roller of the present invention is not limited to that shown in FIG. 2*b*. Another shape of a conical roller having at least one flat portion on a circumferential surface can be adopted according to the present invention. Furthermore, the angle of inclination of the conical roller may be determined in accordance with the kind of the flat articles to be handled. In the embodiment, the two conical rollers are provided, but the number of them is not limited to two. Even when one conical roller is used, the same effect can be obtained.

Figure 3:
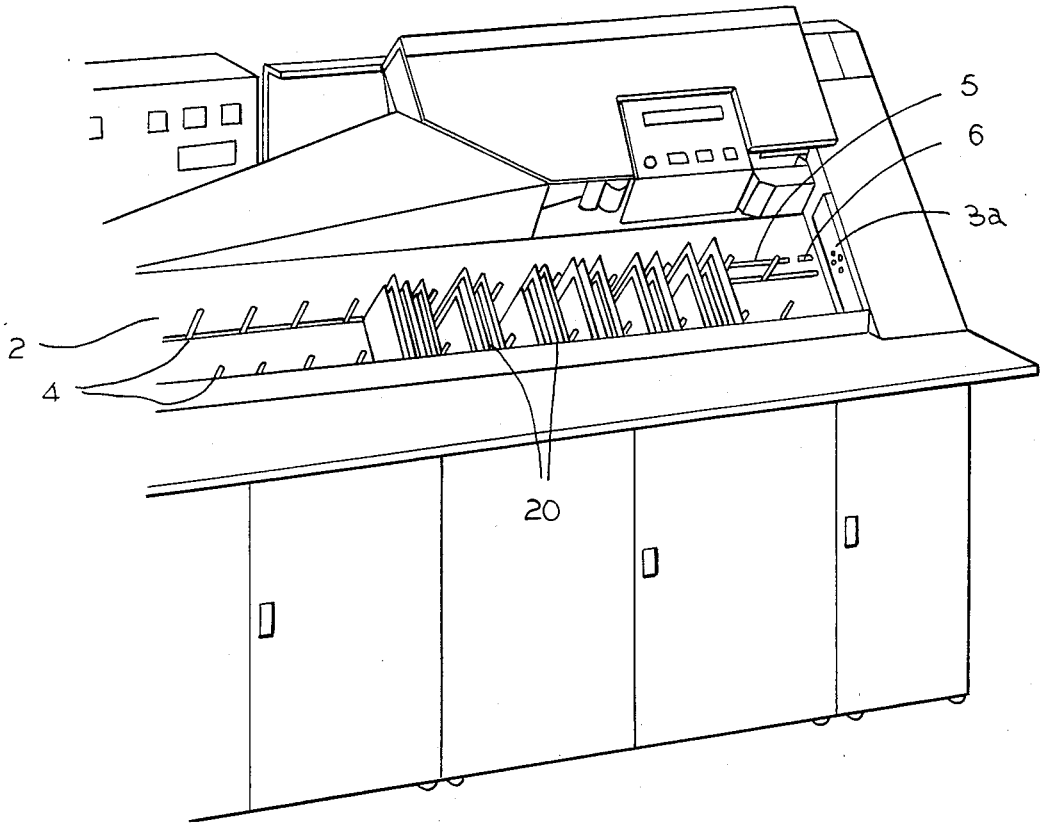
FIG. 3 a schematic perspective view of an example of a flat article handling system using the flat article aligning and feeding apparatus according to the present invention.

FIG. 3 schematically illustrates a flat article handling system including a flat article aligning-and-feeding apparatus according to the present invention. In the system of FIG. 3, a flat article transfer mechanism 4 consists of forks.

As described above, the present invention is featured by conical rollers provided immediately before the feeding section. Accordingly, the stacked flat articles are in soft contacts with each other just before the feeding section and are not pressed forcibly against the feeding section. Therefore, the flat articles can be fed piece by piece reliably and stably from the feeding section.

What is claimed is:

1. An aligning-and-feeding apparatus comprising:

a stacker means for stacking a plurality of flat articles in a standard state;

transfer means for transferring said plurality of flat articles stacked in said stacker means in a first direction toward one end of said stacker means;

feeding means coupled to said one end of said stacker means for feeding flat articles, which are transferred thereto, one by one externally; and roller means provided in said stacker means at a location close to said one end of said stacker means and having an inclined surface and at least one flat surface portion in the inclined surface, for applying a moving force to said flat articles in a direction which is opposite to said first direction and for applying a vibration to said flat articles.

2. An aligning-and-feeding apparatus comprising:

stacker means for stacking a plurality of flat articles in a standing state, said stacker means including two guide plates which support two sides of said flat articles;

feeding means coupled to said stacker means for feeding said flat article sequentially;

transfer means provided for at least one of said two guide plates for transferring said flat articles stacked in said stacker means in a first direction toward said feeding means;

vibration means provided for at least one of said two guide plates for vibrating said flat articles stacked in said stacker means in a second direction which is perpendicular to said first direction; and taper roller means provided for at least one of said guide plates at a location close to said feeding means, one end of said taper roller means with a larger diameter being positioned on the side of said feeding means, the outer circumferential surface of said taper roller means being longitudinally formed to produce at least one flat plane on said taper roller means, for applying a vibrational movement to said flat articles stacked in said stacker means and for applying a moving force to said flat articles in a direction opposite to said first direction.

3. An aligning-and-feeding apparatus comprising:

stacker means for stacking a plurality of flat articles in standing state, said stacker means including two guide plates which support two sides of said flat articles:

feeding means coupled to said stacker means for feeding said flat articles sequentially:

transfer means for at least one of said two guide plates for transferring said flat articles stacked in said stacker means in a first direction toward said feeding means;

vibration means provided for at least one of said two guide plates for vibrating said flat articles stacked in said stacker means in a second direction which is perpendicular to said first direction; and two taper roller means respectively provided for said two guide plates at a location close to said feeding means and each of said tapered roller means having an inclined surface and at least one flat surface portion in the inclined surface for applying a moving force to said flat articles in a direction which is opposite to said first direction and for applying vibration to said flat articles.

* * * * *